US005501164A

United States Patent [19]

Porter et al.

[11] Patent Number: 5,501,164

[45] Date of Patent: Mar. 26, 1996

[54] APPARATUS FOR ASSEMBLY OF PILLOW-TOP MATTRESS COVERS

[75] Inventors: Michael R. Porter, Topsfield; Charles E. Mulcahey, Beverly; John J. Kirby, Hamilton, all of Mass.

[73] Assignee: Porter Sewing Machines, Inc., Beverly, Mass.

[21] Appl. No.: 422,151

[22] Filed: Apr. 14, 1995

Related U.S. Application Data

[63] Continuation of Ser. No. 101,941, Aug. 4, 1993, abandoned.

[51] Int. Cl.[6] ..... D05B 1/24; D05B 27/10

[52] U.S. Cl. ..... 112/176; 112/322

[58] Field of Search ..... 112/176, 177, 112/178, 303, 322, 320, 258, 260, 475.01, 318, 475.24

[56] References Cited

U.S. PATENT DOCUMENTS

| | | |
|---|---|---|
| 2,157,032 | 5/1939 | Strobel . |
| 2,168,741 | 8/1939 | Mueller . |
| 2,199,173 | 4/1940 | Gruman . |
| 2,769,415 | 11/1956 | Sigoda . |
| 2,829,614 | 4/1958 | Parry . |
| 2,895,442 | 7/1959 | Parry . |
| 3,031,985 | 5/1962 | Kalning et al. . |
| 3,134,347 | 5/1964 | Seaman . |
| 3,162,157 | 12/1964 | Chinnici, Jr. . |
| 3,338,196 | 8/1967 | Roth . |
| 4,688,500 | 8/1987 | Ichimura . |
| 4,854,254 | 8/1989 | Hsing . |
| 4,896,617 | 1/1990 | Hauser et al. . |

OTHER PUBLICATIONS

Bed Times, Apr. 1992, vol. 120, No. 4, International Sleep Association, pp. cover, 3 and 38.

Declaration of Michael R. Porter, dated Aug. 2, 1995.

*Primary Examiner*—Paul C. Lewis

*Attorney, Agent, or Firm*—Wolf, Greenfield & Sacks

[57] ABSTRACT

An improved method and apparatus for the assembly of pillow-top mattress covers. In the method of this invention, the gussets for a pillow-top mattress cover are prepared in a single step in which the gusset material is folded longitudinally, and the flange material is attached thereto and the gusset material is sewn together in one stitch. Thereafter, a gusset is attached to each of the top and bottom panels of the cover along its outer edge. Each gusset is secured to the underside of its associated top or bottom panel at the folded edge using a blind stitch which is not visible externally of the panel. No gluing is required. During the step of attaching the gusset to its associated mattress cover panel, precisely positioned mitered corners are formed on the gusset where the gusset is to be attached to the corner of its associated panel. In the apparatus of this invention, a conventional blind stitch machine is modified to accept thicker work by providing a wider cam for urging work into the needle area, top and bottom feed rollers disposed even with the needle, and pneumatic control of the lower support arm.

6 Claims, 9 Drawing Sheets

APPARATUS FOR ASSEMBLY OF PILLOW-TOP MATTRESS COVERS

This application is a continuation of application Ser. No. 08/101,941 filed Aug. 4, 1993 now abandoned.

FIELD OF THE INVENTION

This invention relates generally to a method and apparatus for assembling mattresses, and more particularly to a method and apparatus for sewing together in an efficient manner the components of the cover of a pillow-top mattress.

BACKGROUND OF THE INVENTION

So-called pillow-top mattresses have become fashionable in recent years. Through the provision of gussets, one for each of the top and bottom panels, such mattresses are constructed to appear as though a comforter or pillow has been placed on a conventional mattress to provide a more luxurious and comfortable appearance. The gussets extend around the perimeter of the mattress and connect the side panels to top and bottom panels of the mattress cover.

Pillow-top mattresses are typically far more expensive to manufacture than conventional mattresses, because of the additional manufacturing steps required to incorporate the gusset into the structure of the mattress cover. In conventional mattresses, typically only one tape edge operation is required for each top and bottom panel. The top panel is secured to an adjacent edge of the side panel all the way around the perimeter of the mattress, and this seam is covered with a tape which is stitched to the fabric at the same time the top or bottom panel is joined to the side panel. Prior to this tape edge operation, the side, top and bottom panels of the mattress cover have been precut and sized. Any inaccuracies in cutting and sizing typically can be accommodated by the machine operator by adjusting the position of the fabric during the assembly of the mattress cover.

In the manufacture of pillow-top mattress covers, several additional steps are required, all of which are highly labor intensive. After preparation and cutting to size of the top, bottom and side panels, as in conventional mattresses, the gussets must be assembled and sewn into place. The gussets are each typically formed of a single piece of material which must first be folded to form two flaps which are then stitched together along the folded edge. Each piece of material in the gusset typically includes a layer of fabric wrapped about or secured to a layer of foam or other padding. Thereafter, in a subsequent step, a strip of flange material is secured to one flap of the gusset. The flange material is necessary for attachment of the top and bottom panels of the cover directly to the components of the inner spring frame. This flange material typically is a non-woven material having a high strength.

For each of the top and bottom panels of the mattress cover, one flap of the gusset is stitched to the perimeter of a layer of a liner material. This liner, typically a high strength non-woven material, and its attached gusset are then placed on top of the inner spring and held in place by securing the flange material to the inner spring using attachment devices, such as hog rings. Once the liner is fixed in place, the exterior panel is glued thereto on its undersurface. Thereafter, the mattress is closed by stitching the edge of one flap of the gusset to the edge of the exterior mattress panel and by stitching the edge of the other flap of the gusset to the edge of the exterior side panel using a conventional tape edge sewing machine.

This prior art technique necessitates a gluing step during the assembly of the top and bottom panel of the mattress cover. If the gusset is sewn directly to the panel using existing sewing machines, the stitch would pass all the way through the panel and be externally visible, a result which is highly undesirable. Existing blind stitch machines, which would accomplish the desired result with no externally visible stitch, were incapable of handling materials as thick as pillow-top panels, especially the very thick panels which recently have become popular. The liner to which the gussets are sewn is usually a very thin sheet of material which can be accepted by conventional chain stitch machines. Since this liner is fully concealed by the mattress cover, this conventional stitch is not visible once the mattress has been closed.

During the step of sewing and taping one flap of the gussets to their associated panels, often it is desired to miter the corners of the gusset for a more finished look. If the corners are not mitered, the machine operator must gather the material to accommodate the extra material at the corners. Unless the operator is particularly skilled, sometimes the result is a rather uneven look, since the mattress covers are unwieldy and difficult to maneuver around the corners.

In existing systems, where mitered corners are desired, the operator typically cuts an extended length of previously formed gusset material at measured locations where the corners of the cover are expected to be, and the mitered corner is formed on the gusset material before it is attached to the panel. However, due to the nature and construction of the mattress cover material and of the gusset material, often the gussets and panels shrink or change shape at differing rates if left to sit, thus somewhat altering the location of the pre-mitered corner on the gusset material with respect to the corner on the mattress panel. This change occurs more frequently when the gusset is manufactured well in advance of the date of assembly of the mattress cover. Since the mitered corners on the gusset are not aligned precisely with the corners of the mattress cover panel, an accommodation has to be made by the operator at the time the gusset is attached to the mattress cover panel, such as by gathering the material or stretching where necessary to properly position the mitered corner. This adjustment results in extra operator time, as well as the possibility that the mitered corner is not properly positioned, or that the corner exhibits an uneven or undesired appearance. Even where the operator is able to properly position the mitered corner, the required stretching or gathering of the material produces a mattress cover which does not have the desired look and which might not be acceptable to all purchasers.

As can be seen, the prior art process for producing a pillow-top mattress cover requires many sewing steps, each of which must be manually controlled. Also, because of the large number of steps, greater opportunities exist for errors and for the production of mattress covers which are not uniform in look or which do not meet specifications. Finally, because existing blind stitch machines cannot sew gussets to mattress cover panels, a gluing step has become an accepted necessary practice in the industry. There are a number of drawbacks to gluing. It requires the introduction of a gluing step into the assembly process requires additional machinery and additional workers. Also, provision must be made for proper ventilation and removal of the fumes from the glue. The result is additional plant costs, which serve to increase the overall cost of manufacture.

There are several reasons why existing blind stitch machines are not suitable for making mattress covers. In the first place, typically only a bottom feed is provided, which comprises a roller or a pair of rollers which pulls the material through the stitching zone. In existing machines, this bottom feed is positioned behind the needle with respect to the direction of movement of the work. Thus, when the work is first introduced into the stitching zone, there is no positive feed until the stitching process has proceeded sufficiently far to allow the feed to grip the lower surface of the work being stitched. Also, because the feed is located behind the needle or stitching zone, when it is used with a large piece of work, such as a mattress cover, and when the mattress cover is rotated to accommodate a corner, the work occasionally breaks loose from the feed, requiring the operator to manually feed or move the work around until it again is engaged by the feed. This produces an uneven result, requires more operator attention, and could result in operator injury.

Secondly, most blind stitch machines presently available are not suitable for accommodating work as bulky and thick as a mattress cover panel. Existing blind stitch machines do not sufficiently press the thick fabric against the upper foot to allow the machine to produce the desired stitch. Also, the arm below the fabric cannot be pivoted sufficiently far out of the way to accept the work. Finally, the arm vibrates or bounces during sewing producing an uneven stitch.

It is therefore an object of the present invention to provide a method and apparatus for the assembly of pillow-top mattress covers which reduces the number of sewing steps and therefore reduces the cost of assembly.

It is a further object of the present invention to provide a method and apparatus for the assembly of pillow-top mattress covers which provides a more uniform result.

It is another further object of the present invention to design a blind stitch machine capable of being used for the assembly of pillow-top mattress covers.

It is yet another further object of the present invention to provide a method and apparatus for the assembly of pillow-top mattress covers which eliminates the need for a gluing step.

SUMMARY OF THE INVENTION

In accordance with the above and other objects of the invention, an improved method and apparatus are provided for the assembly of pillow-top mattress covers in which several of the assembly steps are combined into one step, so that the overall number of steps is significantly reduced. Also, a method and apparatus are provided which assure that mitered corners on the gusset are properly positioned. Finally, an improved blind stitch machine is provided which has been modified to specifically accommodate the requirements of sewing a pillow-top mattress cover so that the gluing step may be eliminated.

In accordance with one aspect of the invention, a single machine is provided for making the gusset and for attaching the flange material. This machine folds the gusset, stitches it together in its folded condition, and secures the flange material to the gusset. This combination of steps eliminates the need to separately attach the flange material. In this step, the gusset material and flange material are fed together into one sewing machine. The gusset material is fed continuously from a spool through a specially configured folder which longitudinally folds the material in half as it is being fed to the stitching zone. At the same time, the flange material is being fed beneath the folder and into the stitching zone from a separate spool. As the flange material reaches the stitching zone of the sewing machine, it has already been folded in two, and aligned with the flange material. A single stitch then secures the gusset material in its folded condition and attaches the flange material thereto. The finished gusset is now ready to be cut into lengths and bound to a mattress panel.

In the next step, the free edge of the upper flap of the gusset is bound and taped to an outer edge of its associated mattress panel in a single step. The free edge of the upper flap of the gusset is placed adjacent the outer edge of the mattress cover panel, a tape is wrapped about the edges, and the resulting combination is stitched together by a binding machine.

In conjunction with the foregoing operation, a mitering station is provided closely adjacent the binding machine. When it is desired to miter a corner of the gusset, as the operator approaches a corner of the mattress cover panel, the binding machine is stopped, and the operator measures exactly the distance from that point to the corner of the panel. An equivalent distance is marked on the gusset material. The operator then pulls that part of the gusset material over to the closely adjacent mitering station. The gusset material is first folded transversely at that point. Next, two stitches are applied by a sewing machine to the gusset from the folded edge inwardly. Each stitch is at a 45 degree angle with respect to the folded edge of the gusset, so that the stitches form a 90 degree angle with respect to each other. The sewing machine preferably is preprogrammed to stitch precisely the desired number of stitches needed for the miter. All the operator must do is wait until the stitches have completed, rotate the gusset material through 90 degrees and start-the machine again. Thereafter, the triangular section defined by the stitches and the folded edge is cut out of the gusset material either automatically, or manually, and the gusset material is removed from the mitering station. The binding step is again restarted, and as the mitered portion of the gusset material approaches the corner of the mattress cover panel, the operator pulls the V-shaped section of the gusset material together so it is stitched around the corner in a closed position to produce the desired mitered corner. The mattress cover panel is rotated during this procedure and the process resumes along the next perpendicular edge of the mattress cover panel. The placement of the mitering station in close proximity of the binding machine allows precise placement of the mitered corner of the gusset with respect to the corner of the mattress cover panel, and obviates the need to remove the mattress cover panel from the binding machine for separate mitering.

In the next step of the method for constructing the mattress cover, the gusset is secured along its folded edge to the underside of its associated mattress cover panel. This attachment is performed using a blind stitch machine. No gluing step is required.

Finally, once the foregoing steps have been completed, the flange material is secured to the interior structure of the mattress, using hog-rings or the like, and the free edge of the lower flap of the gusset is secured to the adjacent edge of the side panel. This step is performed for each of the top and bottom panels of the mattress cover so that the mattress is finally closed. A binding machine like that used for the binding of the gussets to the top and bottom panels is used for this step.

A conventional blind stitch machine has been modified to accommodate the mattress cover panels for this process. The lower feed has been moved to a point directly opposite the stitching area, so that as the mattress cover panel enters the stitching zone, it is simultaneously being engaged by the lower feed. In addition, an upper positive feed is provided directly opposite to the lower feed. In this manner, the mattress cover panel is captured between the upper and lower feed and is fed uniformly through the stitching zone, preventing uneven feeding of the top and bottom portions of the panel and providing a better stitch. Even when corners are being stitched, the mattress cover panel does not pull free of the feed. The conventional blind stitch machine has also been modified to provide a larger cam to provide more surface area in urging the thick mattress cover panel between the top shoes to provide a better stitch. Finally, the lower arm of the machine has been provided with a pneumatic cylinder and another spring. The spring urges the arm upwardly against the material with a predetermined force to prevent bouncing or vibrations in the arm during the stitching step. The pneumatic cylinder allows retraction of the arm to facilitate initial feeding of the material into the machine.

BRIEF DESCRIPTION OF THE DRAWINGS

The invention will be more fully appreciated from the following detailed description when taken in conjunction with accompanying drawings, in which.

DETAILED DESCRIPTION OF THE INVENTION

Figure 1:
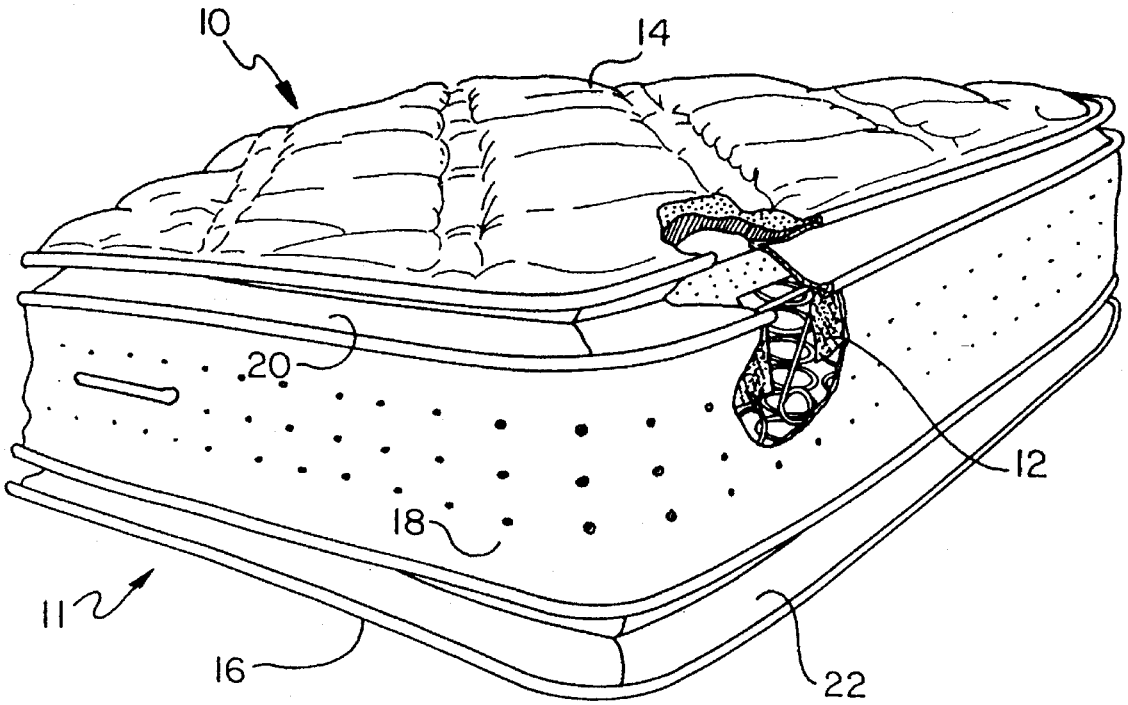
FIG. 1 is a partially cutaway, perspective view of a pillow-top mattress of the type constructed in accordance with the present invention.
Figure 2:
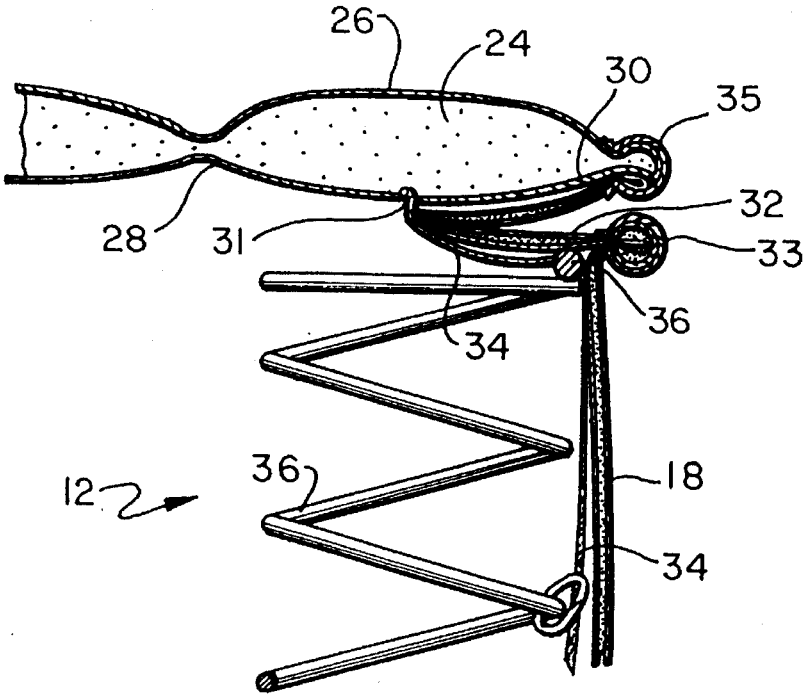
FIG. 2 is a cutaway, cross-sectional side view of a portion of the mattress of FIG. 1.

With reference now to the drawings, and more particularly to FIGS. 1 and 2 thereof, the structure of a typical, existing pillow-top mattress 10 will be described. Pillow-top mattress 10 includes an inner spring and frame 12 and a cover 11 which comprises the following elements: a top mattress cover panel 14, a bottom mattress cover panel 16, a side mattress cover panel 18, a top gusset 20, interconnecting top panel 14 and side panel 18, and a bottom gusset 22 interconnecting side panel 18 and bottom panel 16. As shown in FIG. 2, each of panels 14 and 16 typically is formed of a layer 24 of foam, down or other material between two layers 26 of fabric which are stitched together. Each of top and bottom gussets 20 and 22 comprises an upper flap 30 which is adapted to be secured to a respective one of top panel 14 or bottom panel 16, and a lower flap 32 which is adapted to be adjacent to inner spring and frame 12 and secured to an adjacent edge of side panel 18. Each gusset 20 and 22 includes a strip of flange material 34 which is secured to elements of inner spring and frame 12, such as by hog-rings, staples or the like. Flange material 34 can be formed of any suitable material, but typically comprises a non-woven material of high strength. Flange material 34 prevents the cover 11, including panels 14, 16 and 18 from moving with respect to inner spring and frame 12 once the mattress has been assembled and the cover 11 has been closed around frame. Inner spring and frame 12 typically include a plurality of springs 36 or the like secured to support members 38 in a manner well known to those skilled in the art.

Upper flap 30 and lower flap 32 of the gussets may be formed from a unitary piece of material or from two pieces which are stitched together. Typically, flaps 30 and 32 of the gussets are formed of a layer of foam, down or the like which is disposed between two layers of fabric. The layer of fabric of flaps 30 and 32 which is externally visible should be the same as or compatible with the fabric on the exterior of panels 14, 16 and 18. Flaps 30 and 32 are stitched together at one edge along seam 31 which ultimately is stitched to the underside of associated top or bottom panel 14 or 16, as shown. The outer free edge of lower flap 32 opposite seam 31 is stitched to an edge of side panel 18 at seam 33, as shown. The outer free edge of upper flap 30 is stitched to the outer edge of associated top or bottom panel 14 or 16 at seam 35, as shown. Flange material 34 is stitched to gussets 20 and 22 at or near seam 31 and extends parallel to lower flap 32 and curves downwardly parallel to side panel 18 where it is secured to members of inner spring and frame 12.

Figure 3:
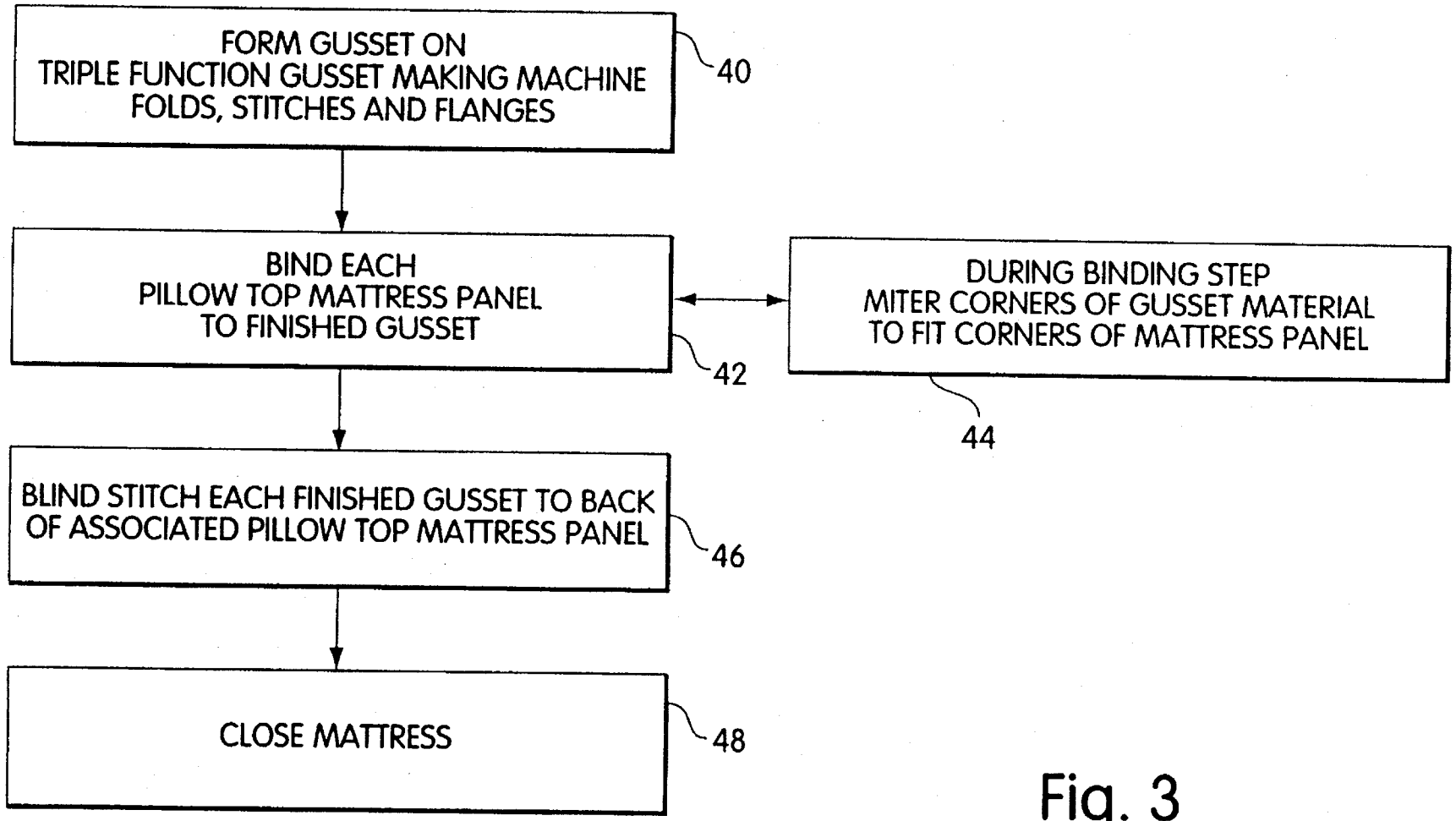
FIG. 3 is a block diagram illustrating the steps in the method of constructing a pillow-top mattress cover according to the present invention.

The method and apparatus for constructing a pillow-top mattress cover 11 of the sort shown in FIGS. 1 and 2 will now be described with particular reference to FIG. 3. The first step in the process is gusset-forming step 40 in which the material for both top and bottom gussets 20 and 22 is assembled. In the present invention, the formation of the gusset material is a one step process which may be performed on one sewing machine. In previously existing techniques for manufacturing pillow-top mattress covers, each of the gusset assembly steps of folding, sewing and flanging was performed separately on different machines.

After forming step 40, the gusset material is cut to suitable lengths and binding step 42 is performed. In binding step 42, the outer, free edge of upper flap 30 of top gusset 20 is bound and taped to the edge of top panel 14. Similarly, the outer free edge of upper flap 30 of bottom gusset 22 is bound and taped to the edge of bottom panel 16. During binding step 42, mitering step 44 is performed in which the corners of gussets 20 and 22 are mitered to conform to the corners of associated panels 14 and 16 to produce a smooth, mitered corner. Because mitering step 44 is performed during binding step 42, as will be described, the mitered corners of gussets 20 and 22 are at precisely the desired location with respect to the rounded corners of respective panels 14 and 16.

After the completion of binding step 42 and mitering step 44, stitching step 46 is performed in which upper flap 30 of each gusset is stitched along seam 31 to the underside of its associated panel 14 or 16. Typically, a blind stitch is used for stitching step 46 so that the stitch is not readily visible externally of gussets 20 and 22 or on the exterior surface of top or bottom panel 14 and 16. This stitching step 46 obviates the step used in assembling most prior art pillow-top mattresses of gluing a liner to the underside of top and bottom panels 14 and 16.

Finally, in closing step 48, inner spring and frame 12 are inserted between top and bottom panels 14 and 16, which are attached, through flange material 34 to inner spring and frame 12. Top and bottom panels 14 and 16 are secured along their respective edges to adjacent edges of side panel 18 at seams 33 to close the mattress. Closing step 48 is a conventional step used for any mattress, and a conventional tape edge machine is used to close and tape seams 33 in a manner well known to those skilled in the art.

Figure 4:
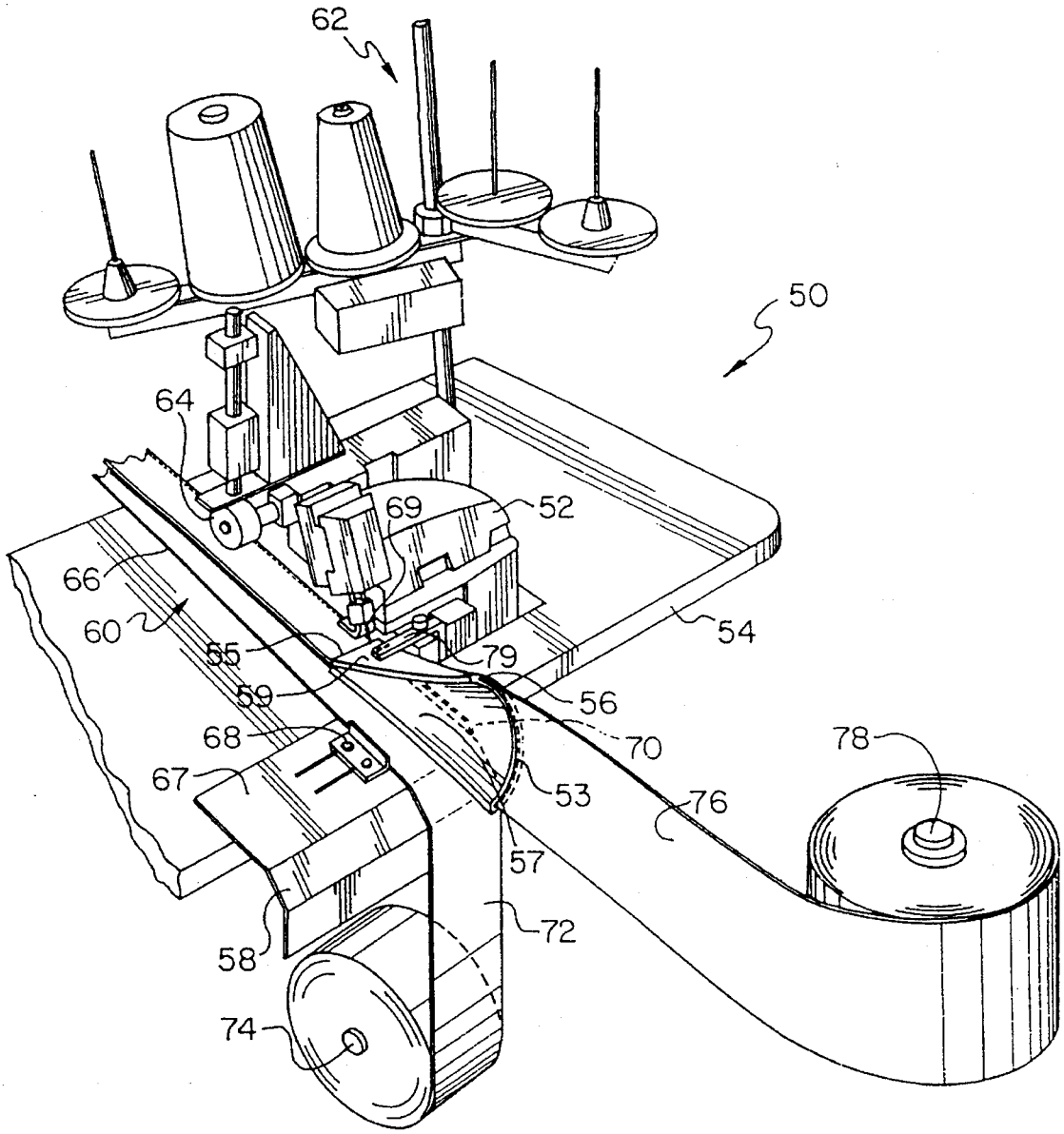
FIG. 4 is a partial, simplified, perspective view of a sewing machine illustrating the formation of the gusset of a pillow-top mattress cover.

Forming step 40 and the apparatus used therefor will now be described in greater detail with particular reference to FIGS. 4 and 5. FIG. 4 illustrates the gusset-maker 50 of this invention. Gusset maker 50 includes sewing machine 52 mounted on table 54, folder 56, flange material guide 58, puller 60, and thread supply 62. Sewing machine 52 is an overcast, stitching machine which is particularly suited to stitching together thick materials. One example of a suitable machine is a model 515-4-26 machine sold by Pfaff Pegasus of USA, Atlanta, Ga. which has been modified for accepting thicker work.

Puller 60 comprises a feed roller 64 which is positively driven by sewing machine 52 to pull the finished gusset material 66 through stitching zone 69 of sewing machine 52. Puller 60 also includes means (not shown) for biasing roller 64 into positive engagement with finished gusset material 66.

Flange material guide 58 includes plate 67 and a pair of guide walls 68 and 70 which direct opposite edges of flange material 72 as it comes off spool 74 so that flange material 72 is properly aligned with gusset material 76 in stitching zone 69 of sewing machine 52. Plate 67 is configured to guide flange material from spool 74 beneath folder 56 to stitching zone 69. Guide walls 68 and 70 typically comprise upstanding walls disposed on surfaces of plate 67. Wall 70 is fixed, while wall 68 may be adjustable with respect to plate 67 in a direction perpendicular to the direction of movement of flange material 72 to accommodate different widths of flange material 72. Wall 70 controls the edge of flange material 72 adjacent thereto so that it is always aligned in the proper position with respect to the needle and gusset material 66 in stitching zone 69 of sewing machine 52 to sew that edge to seam 31.

Folder 56 comprises a pair of spaced plates 57 and 59 which form a channel therebetween through which gusset material 76 passes. Plates 57 and 59 are both formed into substantially the same shape and include a first end 53 and second end 55. First end 53 is adapted to receive gusset material 76, and end 55 is disposed in alignment with and closely spaced from stitching zone 69 of machine 52. Folder 56 receives gusset material 76 from spool 78 and folds gusset material 76 longitudinally by the time the material is dispensed into stitching zone 69 of sewing machine 52. Material 76 is typically, although not necessarily, in half. Folder 56 is preferably mounted on a bracket 79 which spaces the lower edge of folder 56 a predetermined distance above plate 67 so that flange material 72 may pass beneath folder 56.

End 53 is formed into a slightly curved or C-shape. Folder 56 gradually and uniformly changes shape from end 53 to end 55 at which point folder 56 assumes the shape of a side-ways "U" in which the closed end of the "U" faces stitching zone 69, one arm of the "U" is horizontal and the two arms of the "U" are closely spaced. This shape results from plates 57 and 59 being completely doubled over, and provides the folded configuration desired for gusset material 76 as it exits folder 56.

Preferably, folder 56 is removable from bracket 79, so that different size folders 56 can be used for gusset materials 76 having different widths, or different thicknesses. Typically, folders 56 are custom made for the particular gusset material 6 to be used. The cross-sectional dimensions of the channel between plates 57 and 59 should be configured as closely as possible to the thickness and width of gusset material 76 which passes therethrough. Typically, folder 56 is aligned so that the lower edge of plate 59 is disposed roughly parallel to the top of table 54, or to flange material 72 as it passes over plate 67. As a result, end 53 is pitched in a slightly upward facing direction with respect to end 55. Consequently, to assure the smooth flow of gusset material 76 from spool 78 into end 53, spool 78 is aligned at a slight angle with respect to the vertical so that gusset material enters folder 56 in a direction roughly perpendicular to the alignment of end 53.

Forming step 40 will now be described more particularly with reference to gusset-maker 50 of FIG. 4 and FIG. 5. Gusset material 76 is manually fed from spool 78 into end 53 of folder 56, through folder 56 and out through end 55. Material 76 is advanced manually until it passes through stitching zone 69 and through and past puller 60. As previously described, preferably spool 78 is aligned at a slight angle with respect to the vertical so that gusset material 76 enters smoothly and without impediment into end 53. At the same time, flange material from spool 74 is manually passed between walls 68 and 70 of guide 58, through stitching zone 69 of sewing machine 52 and beneath roller 60. Thread from thread supply 62 is fed into sewing machine 52 in a manner well known to those skilled in the art. Once sewing machine 52 has been actuated, gusset material 76 and flange material 72 are automatically drawn through stitching zone 69 of sewing machine 52, and flange material 72 is aligned with and urged into contacting relation with folded-over gusset material 76. The edge of flange material 72 adjacent wall 70 is stitched to the folded edge of the gusset material 76 using an overcast stitch in a manner well known to those skilled in the art. The completed gusset material 66 then is drawn past puller 60 and either is accumulated on a spool or is festooned on the other side of gusset-maker 50 in a manner well known to those skilled in the art. Thus, the gusset material is folded and stitched, and attached to flange material 72 all in one step.

Figure 5:
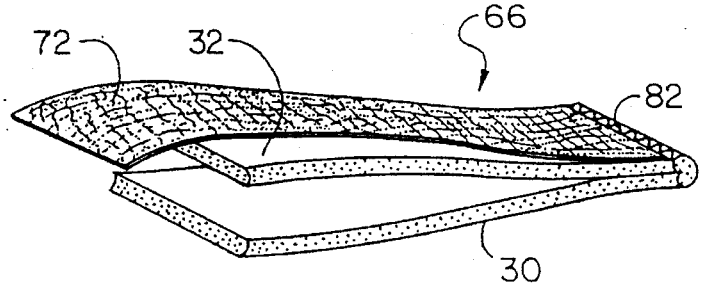
Fig.5 (PRIOR ART)
FIG. 5 is a perspective view of a cross-section of a typical gusset illustrating the structure thereof.

A segment of finished gusset material 66 is shown in FIG. 5 having flaps 30 and 32. Gusset material 66 includes folded edge 82 to which one edge of flange material 72 has been attached. Flange material 72 extends beyond the edges of gusset material 66, as shown, to assure sufficient material for attachment to mattress inner spring and frame 12, as already described.

Figure 6:
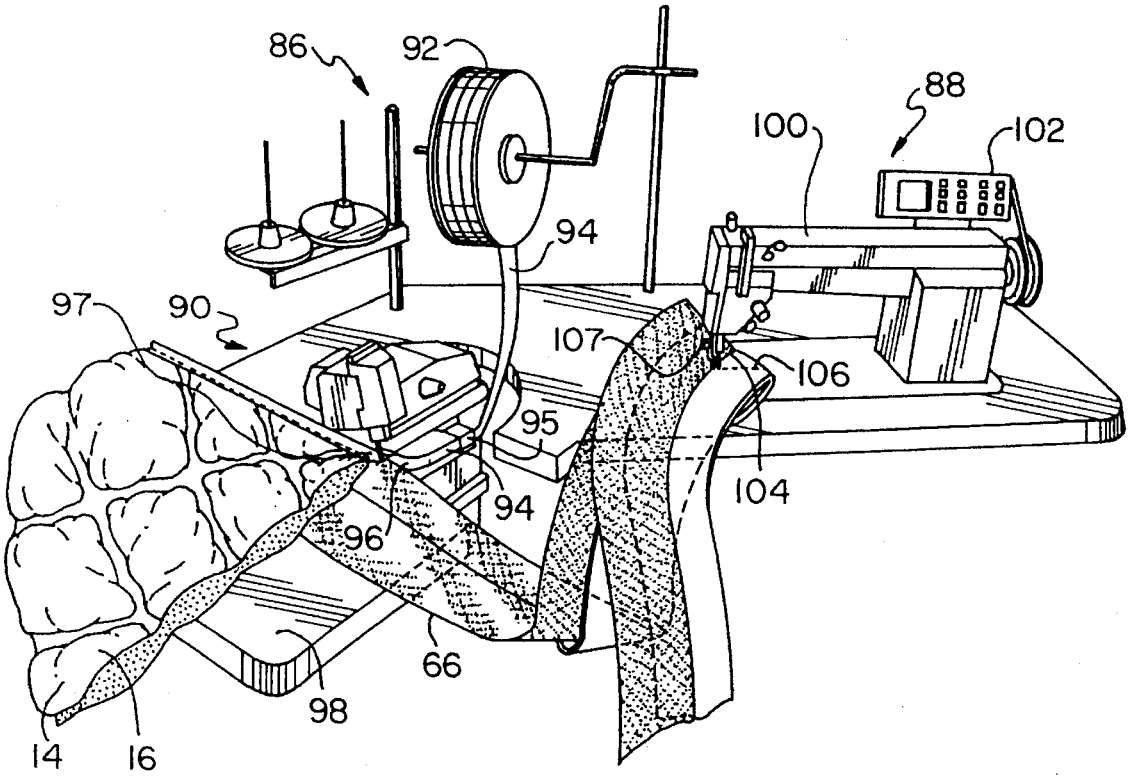
FIG. 6 is a partial, simplified, perspective view of a binding machine and a mitering station illustrating the securing of the gusset to the mattress cover and the forming of the mitered edge in the gusset.

The apparatus and method used for binding step 42 and mitering step 44 will now be described with particular reference to FIGS. 6–11. FIG. 6 illustrates binding machine 86 and mitering machine 88. Binding machine 86 and mitering machine 88 are used in conjunction with one another, and therefore are found in close proximity to one another, substantially as shown. The machine operator must be able to take a portion of the finished gusset material 66 to mitering machine 88 while gusset material 66 is being secured to a mattress cover panel by binding machine 86.

Binding machine 86 includes sewing machine 90, a source 92 of tape material 94, tensioner 95 for tape material 94, tape material guide 96 and table 98 to which machine 90 is mounted.

Sewing machine 90 preferably is a chain stitch machine which has been modified to handle heavy work. A preferred machine is a Pegasus 401 which has been modified substantially in accordance with the modifications described in U.S. application Ser. No. 07/854,373 filed on Mar. 19, 1992 in the name of the inventors herein and assigned to the assignee of the present application. U.S. application Ser. No. 07/854,373 which issued as U.S. Pat. No. 5,309,854 is specifically incorporated herein by reference. The sewing machine described in the above-referenced patent is an overcast stitch machine while machine 90 is a chain stitch machine. However, the modifications made to machine 90 are otherwise the same as those described in the above-referenced patent. In a preferred embodiment, mattress cover panel 14 or 16 and gusset material 66 are fed through the stitching zone of machine 90 by a walking foot mechanism substantially as described in the foregoing U.S. patent.

Source 92 typically is a spool which contains tape material 94 and which dispenses tape material 94 for use in sewing machine 90. Tape material 94 passes through tensioner 95 which typically comprises a pair of spaced plates which are biased together, and between which tape material 94 passes. The purpose of tensioner 95 is to provide drag on the tape material 94 as it is drawn into stitching zone 97 of machine 90 to make certain that tape material 94 is applied tightly without any creases or folds to the mattress cover panel as gusset material 66 is affixed thereto.

Figure 7:
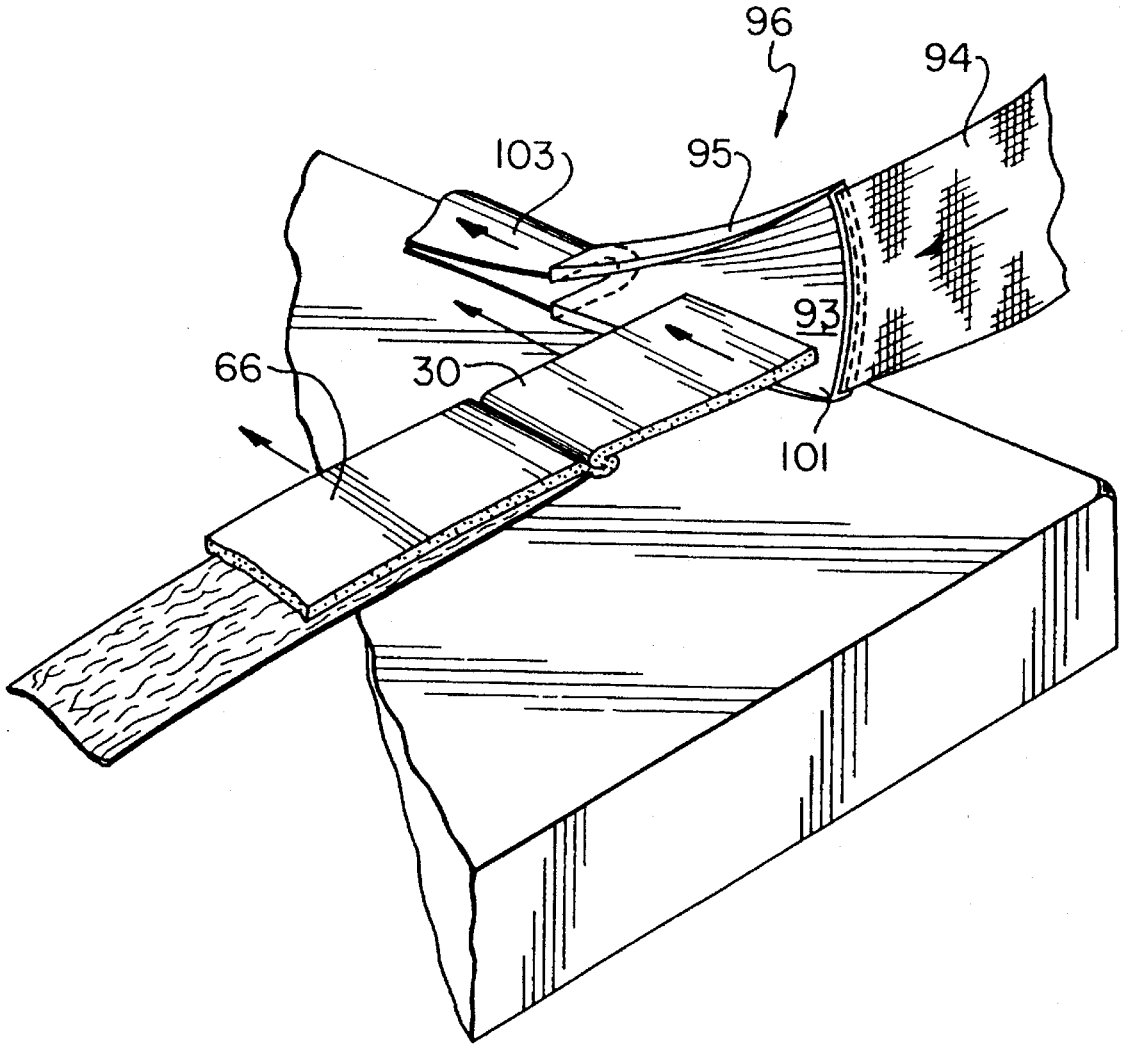
FIG. 7 is a schematic view of a portion of the binding machine of FIG. 6 showing the tape guide.

As shown in FIG. 7, guide 96 typically has a C-shape in cross-section and is formed of a pair of spaced C-shaped metal plates 93 and 95 which define a passageway therebetween. Guide 96 has a configuration similar to that of folder 56. Tape material 94 passes through this passageway entering at nearly vertical end 101 and exiting at C-shaped end 103. Material 94 exits folded longitudinally into a C-shape in which the arms of the C partially surround the outer free edge of upper flap 30 of gusset material 66 and the outer edge of the mattress panel 14 or 16 where they are to be secured together. Guide 96 also guides the outer free edge of flap 30 of gusset material 66 and the outer edge of the mattress cover panel 14 or 16 which pass together through the inner, arcuate portion of the C defined by inner plate 93 at end 103. While FIG. 7 only shows gusset material 66 for purposes of clarity, it is to be understood that the edge of panel 14 or 16 is aligned with the edge of flap 30 and panel 14 or 16 and placed on top of material 66, as shown in FIG. 6. Guide 96 thus forms tape material 94 into a C-shape and properly aligns tape material 94 with the outer free edge of flap 30 of gusset material 66 and the edge of the mattress panel 14 or 16 so that tape material 94 is wrapped about the outer free edge of flap 30 and the edge of the panel 14 or 16 in the proper configuration. Thereafter, tape material 94 is stitched to the edge of flap 30 and to the edge of the mattress cover panel 14 or 16 to secure them all together.

Mitering station 88 includes a conventional lock stitch machine 100 which has been preprogrammed using control 102 to stitch a predetermined number of stitches. An acceptable commercial version of machine 100 is a Mitsubishi LS2-1180 lock stitch machine which is semi-automatic and programable.

The operation of binding machine 86 and mitering machine 88 to perform binding step 42 and mitering step 44 will now be described. Tape material 94 is unwound from source 92 and passed through tensioning device 95, and is introduced into the passageway in guide 96 at end 101. Thereafter, one edge of the mattress cover panel 14 or 16 is introduced into the arcuate inner portion of guide 96, along with the free edge of upper flap 30 of gusset material 66. The free edge of upper flap 30 is aligned with the edge of the mattress cover panel 14 or 16. This alignment is facilitated by placing these two edges in abutment with the inner arcuate portion of guide 96. The mattress cover panel 14 or 16 and gusset material 66 are typically manually fed into machine 90 and are manually aligned prior to commencing the stitching operation. As the mattress cover panel 14 or 16 and the edge of upper flap 30 are advanced together through guide 96 and into stitching zone 97, tape material 94 is also drawn through guide 96, is dispensed with a C-shape from end 103, and is wrapped about the aligned edges of upper flap 30 of gusset material 66 and the edge of the panel 14 or 16. Sewing machine 90 then forms seam 35 by stitching tape material 94 about the edges of upper flap 30 and the mattress cover panel 14 or 16. An operator usually manipulates the finished product through machine 90 to prevent any binding and to assure the free flow of the gusset material 66 and mattress cover panel 14 or 16 through the stitching zone of machine 90.

Figure 9:
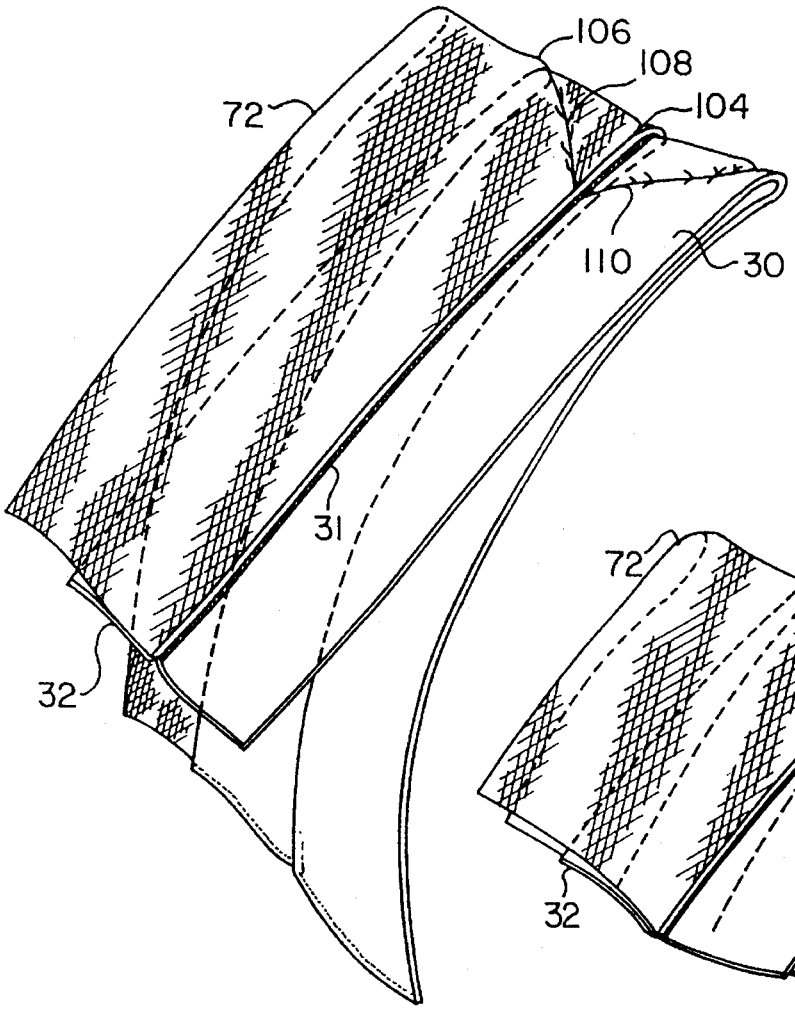
FIGS. 9–11 are partial, perspective views illustrating the steps in the formation of the mitered corner in the gusset for attachment to the pillow-top mattress cover.
Figure 10:
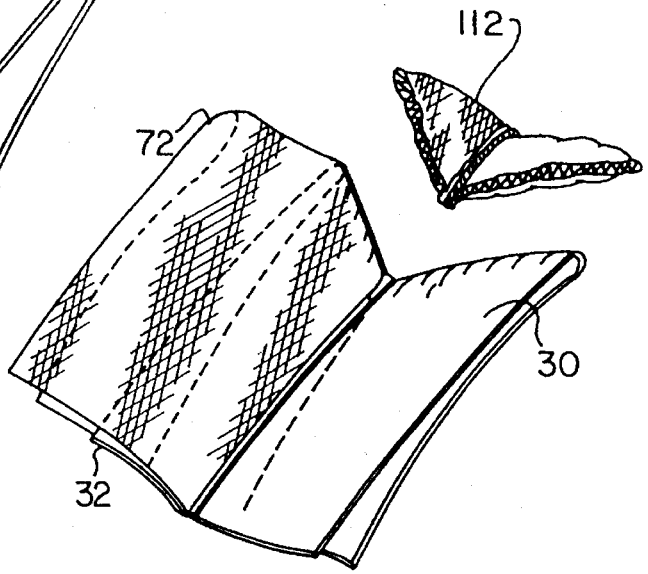

As a corner 114 of the mattress cover panel 14 or 16 is being approached, the operator stops machine 90, and measures the distance along the edge of the mattress cover panel 14 or 16 from stitching zone 97 of machine 90 to the approaching corner 114. The operator then measures the same distance along gusset material 66 to determine the point 104 on the gusset material 66 which will be attached to the corner 114 of the mattress cover panel. The operator then picks up the gusset material 66 and takes that point 104 on the gusset material 66 over to machine 100, and transversely folds the gusset material at that point 104. The operator then places fold 106 of gusset material 66 in the proper orientation beneath the needle 107 on machine 100. Machine 100 has been preprogrammed to stitch a predetermined number of stitches, such as, for example, 27. The transverse fold 106 at point 104 is aligned so that the fold passes beneath the needle at an angle of 45 degrees. Machine 100 performs the predetermined number of stitches 108 on the folded-over gusset material 66 from fold 106 to a point on gusset material 66 away from the edge, as shown in FIG. 9. Thereafter, gusset material 66 is rotated 90 degrees and machine 100 again performs the predetermined number of stitches 110 from the end of the previous stitch 108 back to the folded edge 106. Included in the material stitched in this step is the overlapping portion of the flange material 72. Stitches 108 and 110 are disposed at roughly 90 degrees with respect to one another and are both disposed at an angle of about 45 degrees with respect to fold 106. Preferably, stitches 108 and 110 are designed to intersect at seam 31 of gusset material 66. Preferably, stitch 108 is preprogrammed to extend from an outer free edge of lower flap 32 to seam 31, while stitch 110 is preprogrammed to extend from the outer free edge of upper flap 30 to seam 31. Stitches 108 and 110 thus form the mitered corners of lower flap 32 and upper flap 30 respectively of the gusset.

Figure 11:
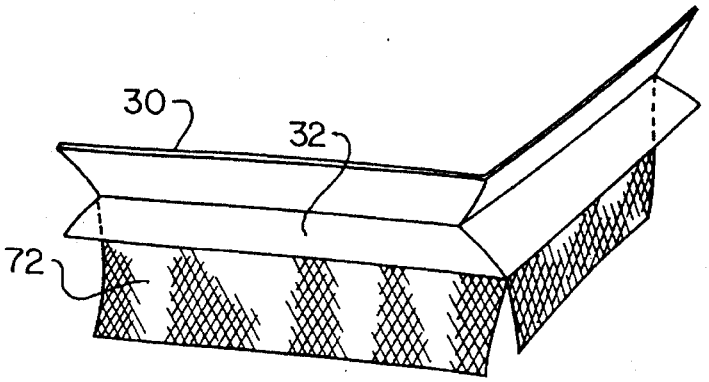

Thereafter, a triangular segment 112 (FIG. 10) of material disposed between stitches 108 and 110 and fold 106 is cut from gusset material 66. This segment 112 also includes a portion of the flange material that overlaps the lower flap 32 of gusset material 66. In addition, the trailing edge of the flange material 72 is cut at right angles to seam 35 to accommodate the corner (FIG. 11). The finished product is shown in FIG. 11. Triangular segment 112 can be removed either manually by cutting along stitches 108 and 110 with a pair of scissors, or automatically using a stamp (not shown), mounted on the table associated with mitering machine 88.

Figure 8:
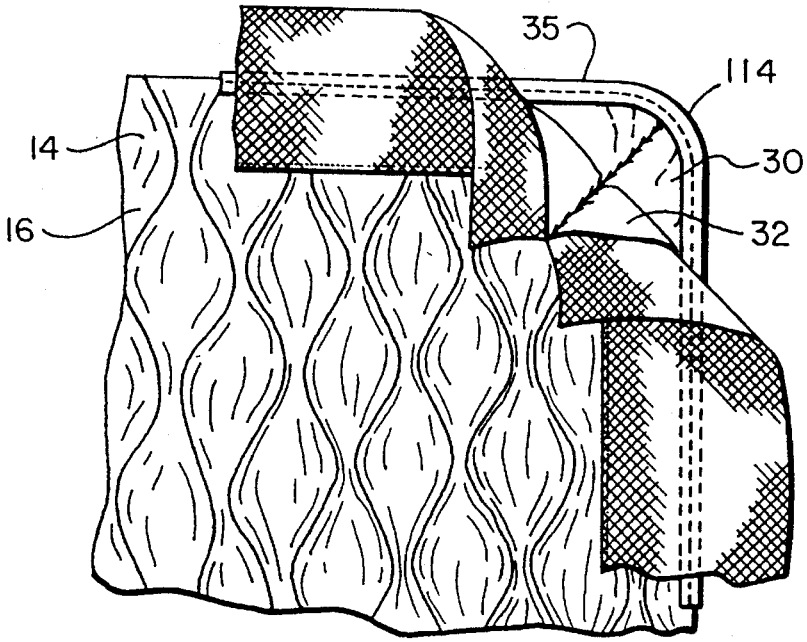
FIG. 8 is a partial, bottom plan view of a pillow-top mattress cover showing the attached gusset.

Once mitering step 44 has been completed, sewing machine 90 is reactivated, and the operator continues to feed the mattress cover panel 14 or 16 and gusset material 66 through stitching zone 97 of machine 90. As corner 114 of the mattress cover panel 14 or 16 is reached, the operator manually pivots the mattress cover panel 14 or 16 90 degrees while continuing the stitching operation. Since the rounded corner of gusset material 66 has already been mitered and properly aligned with corner 114 of the mattress cover panel 14 or 16, the stitching operation proceeds flawlessly and without interruption to form the finished product as shown in FIG. 8 in which the mitered corner of the gusset material 66 is aligned precisely at the center of corner 114 of the mattress cover panel. The operation then continues until the next corner 114 is approached, at which time the mitering step 44 is repeated. This process is continued until all four corners 114 have been stitched and gusset material 80 has been affixed to the mattress cover panel 14 or 16 around the entire perimeter thereof.

Figure 12:
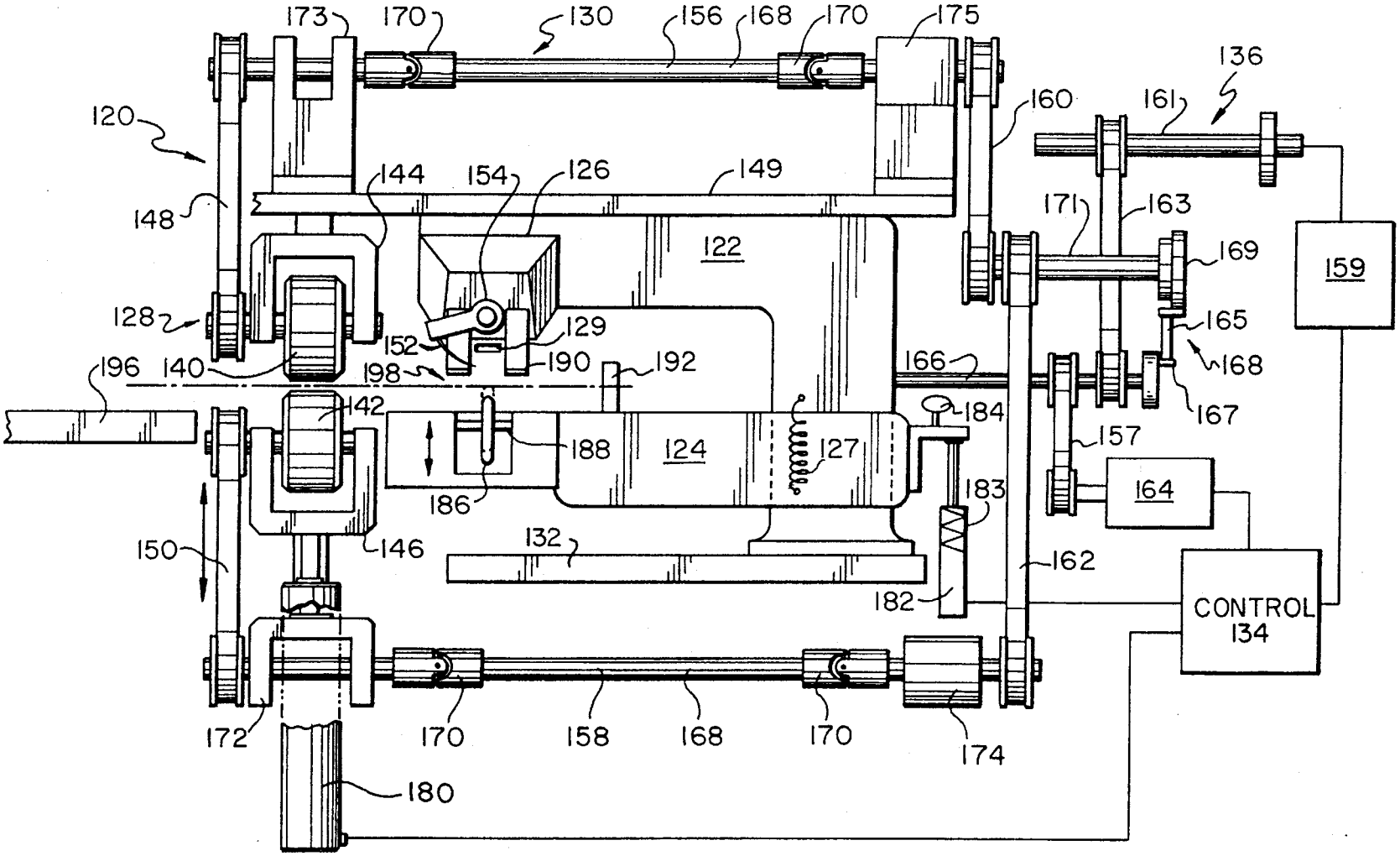
FIG. 12 is a front, schematic view of the improved blind-stitch sewing machine of the present invention.
Figure 13:
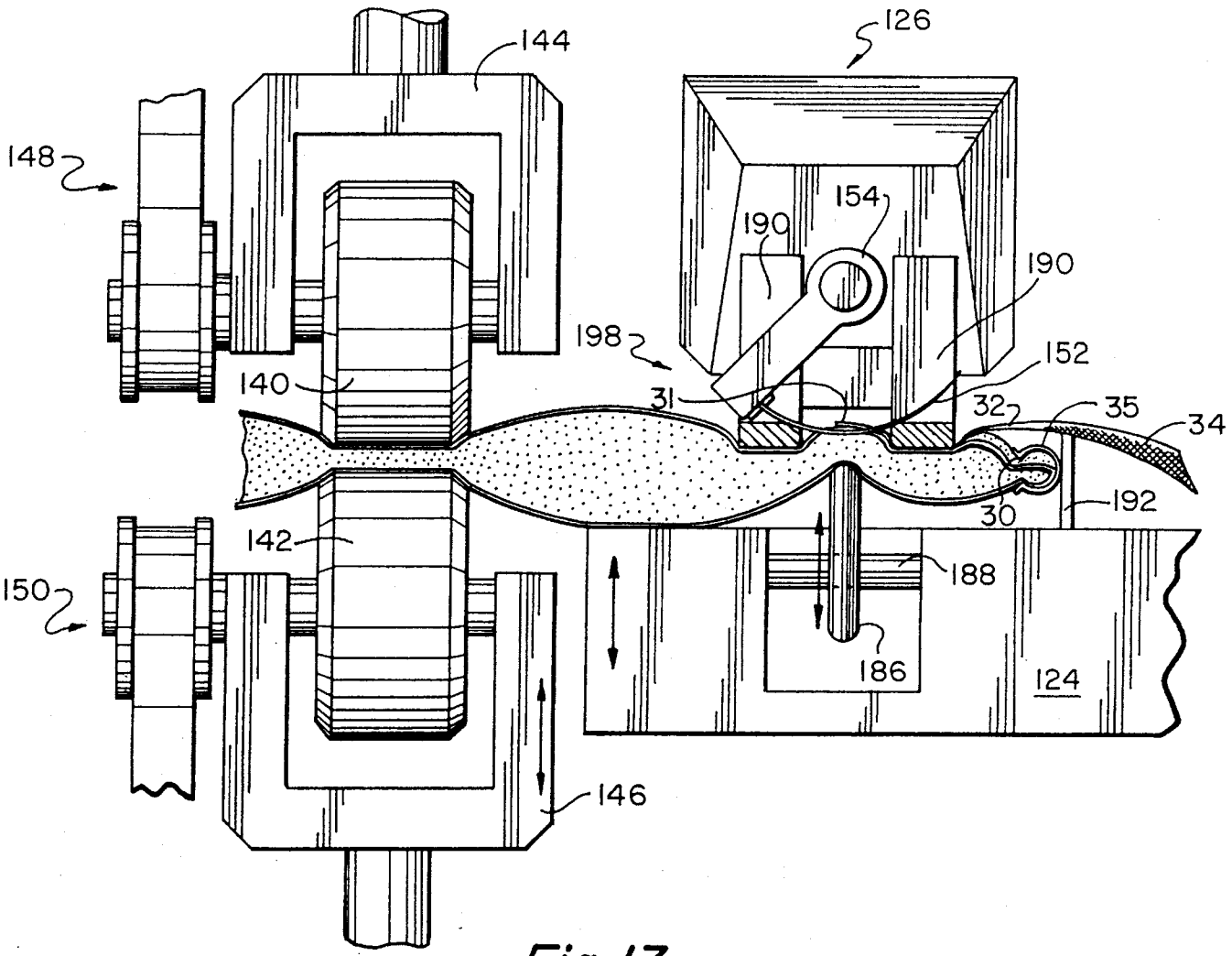
FIG. 13 is a partial front plan view of a portion of the sewing machine of FIG. 12 showing the top and bottom feed rollers and the enlarged cam.
Figure 14:
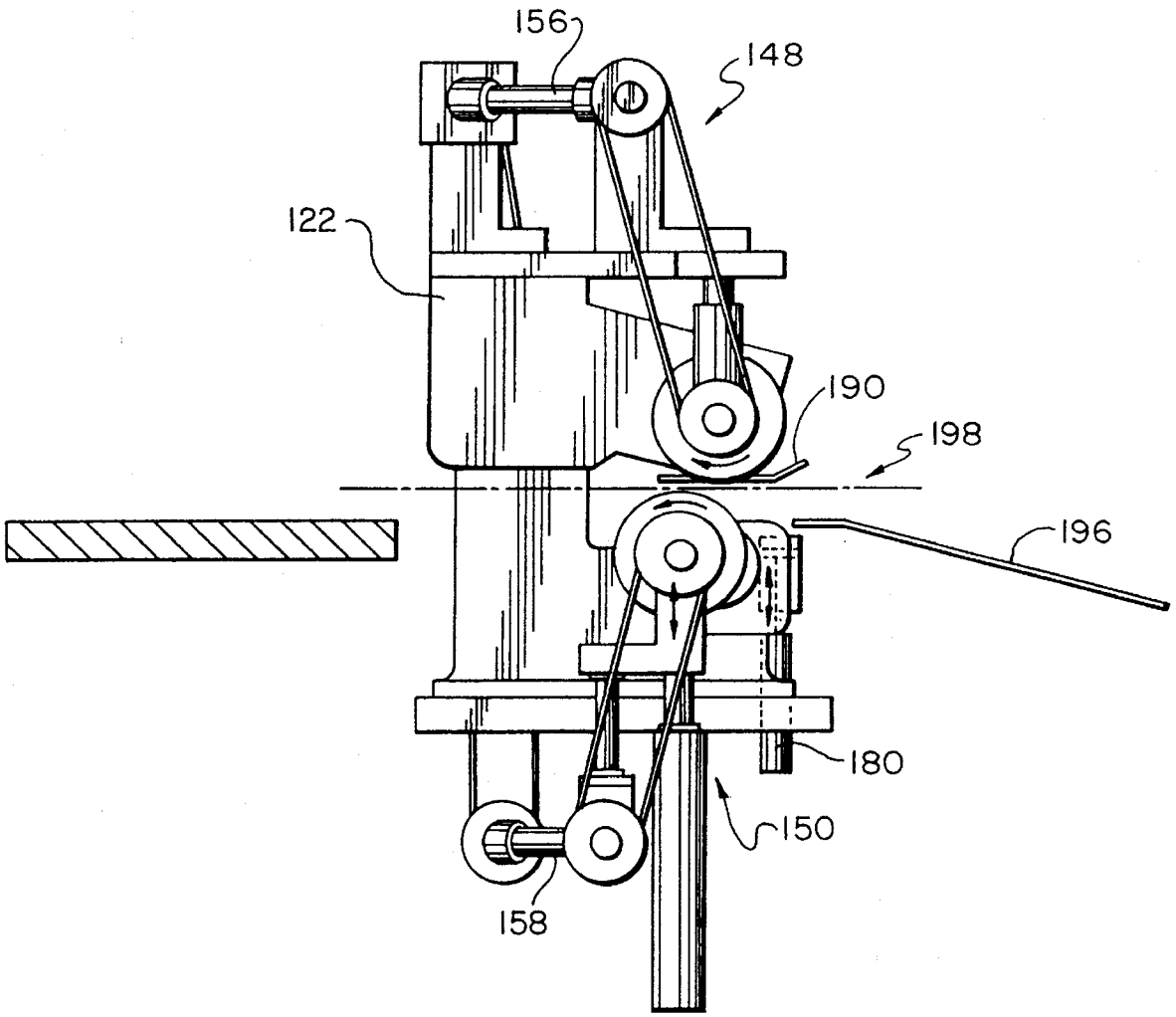
FIG. 14 is a right side plan view of the machine of FIG. 12.

The apparatus and method used for stitching step 46 will now be described with particular reference to FIGS. 12–14. In this step, upper flap 30 of gusset material 66 is stitched adjacent seam 31 to the underside of mattress cover panel 14 or 16. A blind stitch machine 120 which has been modified to accept thick work is used to perform stitching step 46. A blind stitch machine is preferred, since the stitch is not visible on the top external surface of panel 14 or 16, but is applied on the underside of panel 14 or 16 at a point which cannot be seen once the mattress has been closed. The blind stitch used is conventional, but the machine 120 has been modified as described below, specifically for use with mattress cover panels.

Machine 120 preferably is a modified U.S. blind stitch machine model no. 1099-CS-HH-1 as sold by U.S. Blind Stitch Corp. Blind stitch machine 120 stitches in precisely the same way as machine no. 1099-CS-HH-1, and operates in fundamentally the same way, except as described hereinbelow for those portions of the machine which have been modified.

Machine 120 comprises a frame 122, lower support arm 124, stitching assembly 126, feed roller assembly 128, feed roller drive system 130, control 134 and drive system 136. Stitching assembly 126 includes a looper (not shown), a needle 152 which is pivotally mounted for movement about shaft 154, upper shoes 190, and upper feed dog 129. Assembly 126 is attached to frame 122 and is conventional for a blind stitch machine, and will not be further described. Similarly, frame 122 is a casting substantially identical to that found on a conventional blind stitch machine, and also will not be further described. Machine 120 typically sits on a table 132 or other support which is conventional to such sewing machines.

Feed roller assembly 128 is disposed even with stitching assembly 126 so that preferably it is neither in front of nor behind assembly 128 when considered in relation to the direction of movement of work past assembly 128. Feed roller assembly 128 includes a pair of directly confronting, opposed, positively driven rollers, upper roller 140 and lower roller 142. Each roller 140 and 142 is journaled in associated support 144 and 146, respectively, which are mounted to respective supports 173 and 172. Feed roller drive system 130 includes belt drives 148 and 150, belt drives 160 and 162, and linkages 156 and 158. Rollers 140 and 142 are driven by respective belt drives 148 and 150. Belt drives 148 and 150 are coupled through respective linkages 156 and 158 to respective belt drives 160 and 162.

Disposed below stitching assembly 126 and directly opposite roller 142 is arm 124 which supports the work passing through the stitching zone 198 below needle 152. Arm 124 is mounted to frame 122 to pivot eccentrically about an axis generally parallel to its direction of elongation to raise and lower arm 124 with respect to stitching assembly 126, as shown in FIG. 2. Arm 124 is coupled to frame 122 in precisely the same way as existing model no. 1099-CS-HH-1.

Drive system 136 includes a power source 164, such as an electric motor, drive 168 and main machine drive shaft 166 which is coupled to source 164 by belt drive 157. Drive 168 couples shaft 166 to belt drives 160 and 162 through shaft 171. Drive 168 is a reduction unit, so that belt drives 160 and 162, and associated linkages 156 and 158 rotate at a slower rate of speed than shaft 166. In a preferred embodiment of drive 168, an eccentric 167 is mounted onto an end of shaft 166 and eccentric 167 is coupled to a drawn cap roller clutch 169 on shaft 171 by a rod 165. Clutch 169 is adjustable to impart the desired rate of rotation to shaft 171 which, in turn, drives belt drives 160 and 162 at the desired rate of speed. Clutch 169 is manually adjustable so that rollers 140 and 142 are synchronized with upper feed dog 129 on machine 120, so that rollers 140 and 142 advance work through stitching zone 198 in synchronization with and at the same speed as feed dog 129. Shaft 166 is coupled to shaft 161 by belt drive 163. Shaft 161 rotates at the same speed as shaft 166 and in synchronization therewith. Shaft encoder 159 monitors the position and speed of shaft 161 and thus of shaft 166 and reports this information to control 134. The position of shaft 166 is indicative of the positions of machine elements such as needle 152 and feed dog 129. Control 134 makes certain that shaft 166 and thus needle 152 operate at the desired rate of speed and that needle 152 and feed dog 129 are always in a raised position when machine 120 is stopped.

Shaft 166 drives the components of the sewing machine, in a manner well known to those skilled in the art, to activate needle assembly 126 and feed dog 129 to perform the desired stitch. In this respect, machine 120 operates identically to the blind stitch machine model no. 1099-CS-HH-1. Source 164 typically is an electric servo-motor or the like which can be turned on or off at will under the control of control 134. When source 164 is activated, shaft 166 drives the sewing machine causing the stitching action of stitching assembly 126. At the same time, rollers 140 and 142 are activated to move the work through the stitching zone 198 at the desired rate of speed. When control 134 deactivates motor 164, the stitching motion is stopped, and rollers 140 and 142 are deactivated. Thus, the work remains stopped in the proper position, ready for reactuation and continued stitching.

Each of linkages 156 and 158 includes a rod 168 coupled at each end by universal joints 170 to respective supports 173, 175 and 172, 174. Each rod 168 is coupled to an associated belt drive 160 or 162 through respective support 175 or 174. Each rod 168 is also coupled to an associated belt drive 148 or 150 through respective support 173 or 172. Universal joints 170 permit the transfer of rotational power from belt drive 160 to belt drive 148 and from belt drive 162 to belt drive 150 in directions which are other than completely linear to accommodate the particular design configuration of sewing machine 120. Disposed within support 175 is a system of gears which reverses the direction of rotation of linkage 156 with respect to that of belt drive 160. However, the speed of rotation of linkage 156 is identical to that of linkage 158. In this way, rollers 140 and 142 are provided with the desired opposite direction of rotation at precisely the same speed. It is to be understood that other suitable linkages or apparatus for transferring power may be employed within the scope of this invention, so long as both upper roller 140 and lower roller 142 are positively driven at the same rate of speed in opposite directions to feed a piece of work through the stitching zone 198 of machine 120.

Disposed below support 172 and affixed thereto is a pneumatic cylinder 180. Cylinder 180 serves to bias lower roller 142 into engagement with upper roller 140 to apply the proper pressure to the work so that there is no slippage between rollers 140 and 142 and the surfaces of the work. Rigid arm 149, which interconnects supports 173 and 175, prevents any upward movement of roller 140, as shown in FIG. 12, resulting from the upward force applied by cylinder 180. When the work is being inserted into the sewing machine, cylinder 180 retracts roller 142 and support 172 in a downward direction about joint 170, as shown in FIG. 12, to facilitate the placement of work between rollers 140 and 142. Once it is desired to begin the stitching operation, cylinder 180 is activated to raise roller 142 and support 172 in an upward position to bias roller 142 against roller 140 with the desired amount of pressure. Movement of cylinder 180 is controlled by control 134 in a manner well known to those skilled in the art. Gage 184 provides the user with information about the pressure within cylinder 180 so that the upward pressure on roller 142 can be monitored and regulated through control 134 to provide the desired grip on the work.

In prior art blind stitch machines, arm 124 was biased into the sewing position only by a single spring 127 or other like device. When pressure was applied to the spring 127, arm 124 readily pivoted downwardly. Thus, when thick fabrics or fabrics of variable thickness were moved through the stitching zone 198, arm 124 would pivot downwardly at regular intervals, producing a bounce in arm 124 or vibrations which interfered with the proper application of the blind stitch. Also, in existing blind stitch machines, arm 124 did not pivot downwardly sufficiently far to accommodate thick fabrics.

Pneumatic cylinder 182 overcomes these problems by providing a controlled upward force on arm 124. Cylinder 182 includes a spring 183 which provides a greater upward force on arm 124 in addition to that provided by spring 127. Downward movement of arm 124 is produced by cylinder 182 against the bias of spring 127 and 183. Actuation of cylinder 182 is controlled by control 134. When it is desired to insert work into the stitching zone 198, cylinder 182 is activated to pivot arm 124 downwardly, as shown in FIG. 12. This downward motion increases the spacing between arm 124 and shoes 190 to allow insertion of the work. A portion of frame 122 has been removed to allow arm 124 to pivot downwardly a greater distance than in prior art machines. Once the work has been inserted, cylinder 182 is deactivated to allow springs 127 and 183 to raise arm 124 into a support position. In this way, the upward pressure on the work is increased to minimize bouncing of arm 124 due to operation of the machine and differences in the thickness of the work as it passes through the stitching zone.

Disposed on arm 124 is a cam 186 which is eccentrically mounted about shaft 188 to urge the work into a position between shoes 190 where it can be stitched. During the stitching operation, in order for the work to be placed in a position where needle 152 penetrates both items being stitched together, it is necessary to urge the work into the area between shoes 190, since needle 152 is moving in an essentially horizontal direction at that point. Sufficient amounts of both items of the work must be raised into the area between shoes 190, and the work must be raised to a sufficiently great distance within shoes 190 so that needle 152 digs deeply enough into the work to perform a stitch that will have the desired strength and not easily pull out. It was discovered that cam 186 on existing machines did not have a width sufficient to perform this function for adequately stitching the gusset to the underside of the mattress cover panel. Needle 152 would either pass through portions of the cover 14 or 16 but not portions of the flap 30 or vice versa, or, even if needle 152 did penetrate both the cover 14 or 16 and flap 30, it did not penetrate sufficiently deeply in both.

To overcome these problems, cam 186 was provided with a greater width to urge more material between shoes 190. During the stitching operation, cam 186 pivots upwardly about shaft 188, to urge the work between shoes 190, as shown in FIG. 13. Upon retraction of needle 152, cam 186 pivots in a downwardly direction, as shown in FIG. 13, to allow advancement of the work through the stitching zone 198 to the next point at which the needle 152 penetrates the work.

An upstanding guide plate 192 is also provided on arm 124 to allow proper alignment of the mattress cover panel 14 or 16 with respect to the desired location of seam 31. If seam 35 is aligned with guide plate 192, seam 31 is disposed on the underside of panel 14 or 16 in precisely the desired location for stitching.

In prior art blind stitch machines, there exists only a single feed roller. This roller was disposed directly behind and in line with stitching assembly 126, with respect to the direction of movement of the work. Thus, there was no positive engagement of the work by the roller until the work had passed through the stitching zone, and the roller only pulled the work through the stitching zone. Such an arrangement would have been unsuitable for panels 14 and 16. As a corner 114 of panels 14 or 16 would have approached the stitching zone and when the panel 14 or 16 would have required rotation around corner 114, cover 14 or 16 would have become disengaged from the single roller, possibly producing a discontinuity, and requiring extra effort from the operator to continue the uniform feeding of the cover 14 or 16 through the sewing machine.

In this invention, feed roller 140 has been moved to be directly opposite of or even with needle assembly 126 with respect to the direction of movement of the work. In this arrangement, whenever a stitching operation is being performed, the work is engaged positively by roller 140 regardless of whether the work extends behind or in front of assembly 126 with respect to the direction of movement of the work. As a result, panels 14 and 16 will not pull free from roller 140 when they are pivoted around corner 114 thereof. Second roller 142 insures that both layers of panels 14 and 16 are moved through the stitching zone 198 at the same rate so that no distortion is produced in the panels 14 and 16 during stitching. Also, roller 142 assists in moving panels 14 and 16 more smoothly through the stitching zone 198 and ensures that when rounding the corners 114, the panels 14 and 16 do not break free. Cylinder 180 ensures a positive grip between rollers 140, 142 and panels 14 and 16. This positive grip may be enhanced by forming rollers 140 and 142 of rubber or other like materials.

The operation of machine 120 to perform stitching step 46 will now be described with particular reference to FIGS. 13 and 14. In stitching step 46, gusset 20 or 22 is stitched to associated top panel 14 or bottom panel 16 at seam 31 using a blind stitch. At this point, the outer free edge of upper flap 30 has already been secured to its associated panel 14 or 16 at seam 35. In preparation for stitching step 46, panel 14 or 16 is placed upside down on table portion 32 so that flap 30 is facing upwardly and the top surface of panel 14 or 16 is facing downwardly. Panel 14 or 16 is manually urged towards the stitching zone 198. Seam 35 is aligned with guide 192, and flange material 34 is allowed to extend over guide 192 and out of the way of the stitching operation. During this time, cylinder 182 is activated to pivot arm 124 in a downwardly direction to increase the spacing between arm 124 and shoes 190. In addition, cylinder 180 is activated to retract roller 142. As soon as panel 14 or 16 is in the desired position within stitching zone 198, cylinder 182 is deactivated to allow springs 127 and 183 to raise arm 124 to the desired position. Also, cylinder 180 is activated to raise roller 142 into firm engagement with panel 14 or 16 and to capture it between rollers 140 and 142 with the desired pressure as registered at gage 184. These activities are under the control of control 134. The sewing machine is then activated typically by depressing a treadall (not shown), causing cam 186 to pivot about shaft 188 to urge seam 31 into a position where needle 152 penetrates both the material of panel 14 or 16 and the material of flap 30 adjacent seam 31. Needle 152 is then retracted in accordance with a standard blind stitch operation, and at the same time, cam 186 is pivoted downwardly away from shoes 190 to allow advancement of panel 14 or 16 by rollers 140 and 142 in the direction of movement of panel 14 or 16, which is into the page of FIGS. 12 and 13. This process is repeated until the stitching operation has been completed along one side of panel 14 or 16. As corner 114 is reached, the operator pivots panel 14 or 16 about the corner 114, allowing the stitching operation to continue and permitting panel 14 or 16 to be engaged by rollers 140 and 142. Thereafter, the next edge is stitched until the next corner is reached, and the process is repeated. Finally, cylinders 180 and 182 are again retracted, source 164 is deactivated and the machine 120 is ready for the next panel 14 or 16.

The final step in the process of assembling mattress 10 is closing step 48. Closing step 48 is conventional, and need not be described in great detail. Mattress cover panels 14 and 16 are placed on inner spring and frame 12, and the flange material 34 of each of panels 14 and 16 is secured to various members thereof, such as springs 36 or the like, using hog rings or other similar types of attachment devices. During this step, panels 14 and 16 are aligned in the proper location on frame 12. Once panels 14 and 16 have been secured in place, side panel 18 is applied. Panel 18 is attached along one edge to seam 33 of top panel 14 and along the other edge to seam 33 of bottom panel 16. In this step, a conventional tape-edge machine is used which operates much like binding machine 86. Tape is applied to seams 33 at the junction between the edges of side panel 18 and the edges of panels 14 and 16, and the tape is sewn onto these junctions joining side panel 18 to panels 14 and 16. This step is performed first on one of top panel 14 and bottom panel 16, and then on the other of panels 14 and 16. An acceptable, commercially available system used for this purpose is the MATTRESS MASTER™ sold by Gateway Textiles Limited, 13 Lawrence Road, London, England.

The foregoing method and apparatus of this invention permit the manufacture and assembly of higher quality mattress covers for pillow-top mattresses at a much lower cost than methods and apparatuses used in the prior art. Some of the cost savings comes from the consolidation into one step of folding the gusset material, stitching it and applying the flange material. In the prior art, three separate steps were required. Moreover, the elimination of the gluing step by using a blind stitch for securing the gusset to the panels also eliminates substantial cost. The development of a modified blind stitch machine capable of stitching thicker work, such as the mattress cover panels to the gussets, made possible the elimination of the gluing step. A higher quality and lower cost mattress cover is also produced because of the provision of a mitering station closely adjacent the binding machine to allow precise and quick placement of the mitered corners.

In view of the above description, it is likely that modifications and improvements will occur to those skilled in the art which are within the scope of this invention. The above invention is intended to be exemplary only, the scope of the invention being defined by the following claims and their equivalents.

What is claimed is:

1. Apparatus for sewing together two thick materials using a blind stitch, said apparatus comprising:

a frame;

sewing apparatus disposed on said frame for sewing together two materials with a blind stitch;

means for feeding the thick materials to and through said sewing apparatus in a single direction of movement, said feeding means comprising:

two opposed rollers, said rollers being transversely spaced from and generally aligned with said sewing apparatus in a direction generally normal to said direction of movement first means for continuously and positively driving a first one of said rollers in a first direction;

second means for continously and positively driving a second one of said rollers in a second direction opposite of said first direction; and a feed dog transversely spaced from and generally aligned with said rollers in a direction generally normal to said direction of movement.

2. The sewing apparatus as recited in claim 1, further comprising:

means for securing said first one of said rollers to prevent movement thereof toward and away from the materials; and a cylinder for urging said second one of said rollers against said first one of said rollers to capture the material therebetween and for retracting said second one of said rollers away from said first one of said rollers to allow insertion of the materials between the rollers.

3. The sewing apparatus as recited in claim 2, further comprising means for regulating a force provided by said cylinder urging said second one of said rollers against said first one of said rollers.

4. The sewing apparatus as recited in claim 1, further comprising means for causing said first one of said rollers and said second one of said rollers to always rotate at the same speed.

5. The sewing apparatus as recited in claim 1, further comprising:

a support arm disposed below said sewing apparatus for supporting the materials passing through said sewing apparatus, said support arm being pivotally mounted to said frame; and a cylinder operatively connected to said support arm, said cylinder including means for biasing said arm upwardly towards said sewing apparatus and being operable to pivot said support arm downwardly away from said sewing apparatus to allow introduction of the materials to said sewing apparatus.

6. The sewing apparatus as recited in claim 1, further comprising means for synchronizing speed and movement of said rollers with speed and movement of said feed dog, whereby the materials are advanced by said two rollers and said feed dog through said sewing apparatus at generally a same speed and whereby said rollers, said feed dog and said sewing apparatus are activated and deactivated in synchronization.

* * * * *